US005590878A

United States Patent [19]

Takemoto et al.

[11] Patent Number: 5,590,878

[45] Date of Patent: Jan. 7, 1997

[54] GAMING MACHINE ISLAND HAVING A BILL TRANSPORTER ADJUSTABLE TO MATCH THE BILL SLOTS OF GAMING MACHINES OF DIFFERENT DIMENSIONS

[75] Inventors: Takatoshi Takemoto, Tokyo; Hideyuki Kadomatsu, Odawara; Etsuro Sasaki, Kawasaki, all of Japan

[73] Assignee: Kabushiki Kaisha Ace Denken, Tokyo, Japan

[21] Appl. No.: 433,411

[22] PCT Filed: Sep. 19, 1994

[86] PCT No.: PCT/JP94/01538

§ 371 Date: May 19, 1995

§ 102(e) Date: May 19, 1995

[87] PCT Pub. No.: WO95/08373

PCT Pub. Date: Mar. 30, 1995

[30] Foreign Application Priority Data

Sep. 20, 1993 [JP] Japan ..... 5-233188

[51] Int. Cl.[6] ..... A63F 7/36

[52] U.S. Cl. ..... 273/121 B; 273/309

[58] Field of Search ..... 273/121 B

[56] References Cited

U.S. PATENT DOCUMENTS 5,492,326 2/1996 Takemoto et al. ..... 273/118 R

FOREIGN PATENT DOCUMENTS

| | | |
|---|---|---|
| 2-18237 | 1/1990 | Japan . |
| 3242187 | 10/1991 | Japan . |
| 4-20479 | 1/1992 | Japan . |
| 4-123588 | 11/1992 | Japan . |
| 5-5752 | 1/1993 | Japan . |
| 5-57056 | 3/1993 | Japan . |
| 5-96998 | 4/1993 | Japan . |

*Primary Examiner*—Benjamin H. Layno

*Attorney, Agent, or Firm*—Seed and Berry LLP

[57] ABSTRACT

The number of parts is decreased for reducing costs. When a transport unit 70 and an introduction unit 80 are connected, if problems occur because of the outer frame dimension difference between gaming machines 11 or a combination of a gaming machine 11 and a pachinko ball lending machine 20, the transport unit 70 and the introduction unit 80 are expanded or contracted in a transport direction. If the transport unit 70 and the introduction unit 80 are set to a predetermined length, then both the units are fixed by adjustment screws 85*b* and 86*b*. This eliminates the need for manufacturing new transport units 70 or introduction units 80 of different types.

6 Claims, 18 Drawing Sheets

GAMING MACHINE ISLAND HAVING A BILL TRANSPORTER ADJUSTABLE TO MATCH THE BILL SLOTS OF GAMING MACHINES OF DIFFERENT DIMENSIONS

TECHNICAL FIELD

This invention relates to a gaming machine island which comprises a plurality of gaming machines such as pachinko (Japanese pinball) machines at which players play games with pachinko balls, or slot machines at which players play games with game coins and more particularly to a gaming machine island which has gaming machine rows each consisting of a plurality of gaming-machines arranged in a row, game play media lending machines for dispensing game play media (pachinko balls or game coins) when a bill is inserted, and a bill transporter being located behind them for collecting bills from the game play media lending machines.

TECHNICAL BACKGROUND

For a conventional gaming machine island of this kind, the position of the bill slot of each pachinko ball lending machine and the position of a bill introduction unit are determined by the outer frame dimensions of each gaming machine and combination of the gaming, machine and the pachinko ball lending machine for dispensing pachinko balls used for the gaming machine. For example, a drive unit and a transport unit of the bill transporter are connected to define a bill transport passage according to the position of a drive installed in the gaming machine island.

However, in such a gaming machine island, the position of the bill slot of the pachinko ball lending machine is mismatched and the introduction unit for guiding bills from the pachinko ball lending machines to the bill transport passage needs to be changed depending on the outer frame dimension difference between the gaming machines, or a combination of the gaming machine and pachinko ball lending machine. Problems occur at the connection part between the drive unit and the transport unit depending on the position of the drive, and the transport unit and the drive unit needs to be changed each time, thus increasing costs.

DISCLOSURE OF INVENTION

It is therefore an object of the invention to provide a gaming machine island where, for example, transport and introduction units can be expanded or contracted for adjustment in a transport direction, to eliminate the need for providing a large number of unit types, the number of parts being decreased to thereby reduce costs. To this end, according to the invention, there are provided:

1. A gaming machine island (10) wherein a bill transporter for transporting bills in a transport direction is provided on the rears of gaming machine rows (11*a*) facing in opposite directions, each gaming machine row consisting of a plurality of gaming machines (11) and pachinko ball lending machines (20) allowing players to use bills, each pachinko ball lending machine being placed between adjacent gaming machines (11) in the gaming machine rows (11*a*), characterized in that the bill transporter (30) comprises a drive unit (40) having a driving pulley (41) disposed on one end of the gaming machine row (11*a*), a driven unit (50) having a driven pulley (51) disposed on the opposite end of the gaming machine row (11*a*), a conveyor belt (30*a*) being placed on the driving pulley (41) and the driven pulley (51) for turning in the transport direction, bill transport units (70) located along the pulled side of the conveyor belt (30*a*), and introduction units (80) being located corresponding to the pachinko ball lending machines (20) and communicated with discharge ports of the pachinko ball lending machines (20) and connected to the transport units (70) for guiding bills to the transport units (70), in that each transport unit (70) and each introduction unit (80) are connected so as to be able to be expanded or contracted in the transport direction and after the transport and introduction units (70) and (80) are expanded or contracted, they are fixed to a predetermined length by connecting screws (85*b* and 86*b*), and in that at least one of the connection part of the transport unit (70) and the connection part of the introduction unit (80) is formed with adjustment holes (85*a* and 86*a*), which are elongated in the transport direction, in which the connecting screws (85*b* and 86*b*) relatively move when the transport and introduction units are expanded or contracted.

2. A gaming machine island (10) wherein a bill transporter (30) for transporting bills in a transport direction is provided on the rears of gaming machine rows (11*a*) facing in opposite directions, each gaming machine row consisting of a plurality of gaming machines (11) and pachinko ball lending machines (20), each of the pachinko ball lending machines allowing players to use bills and being placed between adjacent gaming machines (11) in the gaming machine rows (11*a*), characterized in that the bill transporter (30) comprises a drive unit (40) having a driving pulley (41) disposed on one end of the gaming machine row (11*a*), a driven unit (50) having a driven pulley (51) disposed on the opposite end of the gaming machine row (11*a*), a conveyor belt (30*a*) being placed on the driving pulley (41) and the driven pulley (51) for turning in the transport direction, bill transport units (70) located along the pulled side of the conveyor belt (30*a*), and introduction units (80) being located corresponding to the pachinko ball lending machines (20) and communicated with discharge ports of the pachinko ball lending machines (20) and connected to the transport units (70) for guiding bills to the transport units (70), in that the drive unit (40) and the introduction unit (80) are connected so as to be able to be expanded or contracted in the transport direction and after the drive unit (40) and the introduction unit (80) are expanded or contracted, they are fixed to a predetermined length by connecting screws, and in that at least one of the connection part of the drive unit (40) and the connection part of the introduction unit (80) is formed with adjustment holes (85*a* and 86*a*), elongated in the transport direction, in which the connecting screws relatively move when the drive and introduction units are expanded or contracted.

3. A gaming machine island (10) wherein a bill transporter (30) for transporting bills in a transport direction is provided on the rears of gaming machine rows (11*a*) facing in opposite directions, each gaming machine row consisting of a plurality of gaming machines (11) and pachinko ball lending machines (20), each pachinko ball lending machine allowing players to use bills and being placed between adjacent gaming machines (11) in the gaming machine rows (11*a*), characterized in that the bill transporter (30) comprises a drive unit (40) having a driving pulley (41) disposed on one end of the gaming machine row (11*a*), a driven unit (50) having a driven pulley (51) disposed on the opposite end of the gaming machine row (11*a*), a conveyor belt (30*a*) being placed on the driving pulley (41) and the driven pulley (51) for turning in the transport direction, bill transport units (70) located along the pulled side of the conveyor belt (30*a*), and introduction units (80) being located corresponding to the pachinko ball lending machines (20) and communicated with discharge ports of the pachinko ball lending machines (20) and connected to the transport units (70) for guiding bills to the transport units (70), in that the driven unit (50) and the transport unit (70) are connected so as to be able to be expanded or contracted in the transport direction and after the driven unit (50) and the transport unit (70) are expanded or contracted, they are fixed to a predetermined length by connecting screws, and in that at least one of the connection part of the driven unit (50) and the connection part of the transport unit (70) is formed with adjustment holes (58*a* and 59*a*), elongated in the transport direction in which the connecting screws relatively move when the driven and transport units are expanded or contracted.

4. A gaming machine island (10) wherein a bill transporter (30) for transporting bills in a transport direction is provided on the rears of gaming machine rows (11*a*) facing in opposite directions, each gaming machine row consisting of a plurality of gaming machines (11), pachinko ball lending machines (20) allowing players to use bills and placed between adjacent gaming machines (11) in the gaming machine rows (11*a*), and end plates (12) forming island ends are disposed outside both ends of the gaming machine rows (11*a*), characterized in that the bill transporter (30) comprises a drive unit (40) having a driving pulley (41) disposed on one end of the gaming machine row (11*a*), a driven unit (50) having a driven pulley (51) disposed on the opposite end of the gaming machine row (11*a*), a conveyor belt (30*a*) being placed on the driving pulley (41) and the driven pulley (51) for turning in the transport direction, and bill transport units (70) located along the pulled side of the conveyor belt (30*a*), in that the drive unit (40) is supported movably in the transport direction on the end plate (12) and after the drive unit (40) is moved in the transport direction to the end plate (12), it is fixed to a predetermined position by connecting screws (12*b*), and in that the drive unit (40) is formed with adjustment holes (46), elongated in the transport direction, in which the connecting screws (12*b*) relatively move when the drive unit is moved in the transport direction.

If the position of a bill slot (21) of the pachinko ball lending machine (20) is mismatched because of the outer frame dimension difference between gaming machines (11) or a combination of the gaming machine (11) and pachinko ball lending machine (20) and a problem occurs when a transport unit (70) and an introduction unit (80) are connected, the transport unit (70) and the introduction unit (80) are expanded or contracted in the transport direction. At this time, the connecting screws (85*b* and 86*b*) move relatively in the elongated adjustment holes (85*a* and 86*a*).

If the transport unit (70) and the introduction unit (80) are set to a predetermined length, then both the units are fixed by the adjustment screws (85*b* and 86*b*). This eliminates the need to manufacture new transport units (70) or introduction units (80) of different types.

Likewise, if the drive unit position changes and problems occurs when the drive unit (40) and the introduction unit (80) are connected, the drive unit (40) and the introduction unit (80) are expanded or contracted in the transport direction. If the drive unit (40) and the introduction unit (80) are set to a predetermined length, then both the units are fixed by the adjustment screws.

Likewise, if problems occur when the driven unit (50) and the transport unit (70) are connected, the driven unit (50) and the transport unit (70) are expanded or contracted in the transport direction. If the driven unit (50) and the transport unit (70) a reset to a predetermined length, then both the units are fixed by the adjustment screws.

Likewise, if problems occur when the drive unit (40) is connected to the end plate (12), the drive unit (40) is moved to the end plate (12) in the transport direction. If the drive unit (40) is moved to a predetermined position of the end plate (12), then the unit is fixed by the adjustment screws (12*b*).

BEST MODE FOR CARRYING OUT THE INVENTION

Referring now to the accompanying drawings, there is shown one embodiment of the invention.

FIGS. 1 to 21 show the embodiment of the invention.

Figure 1:
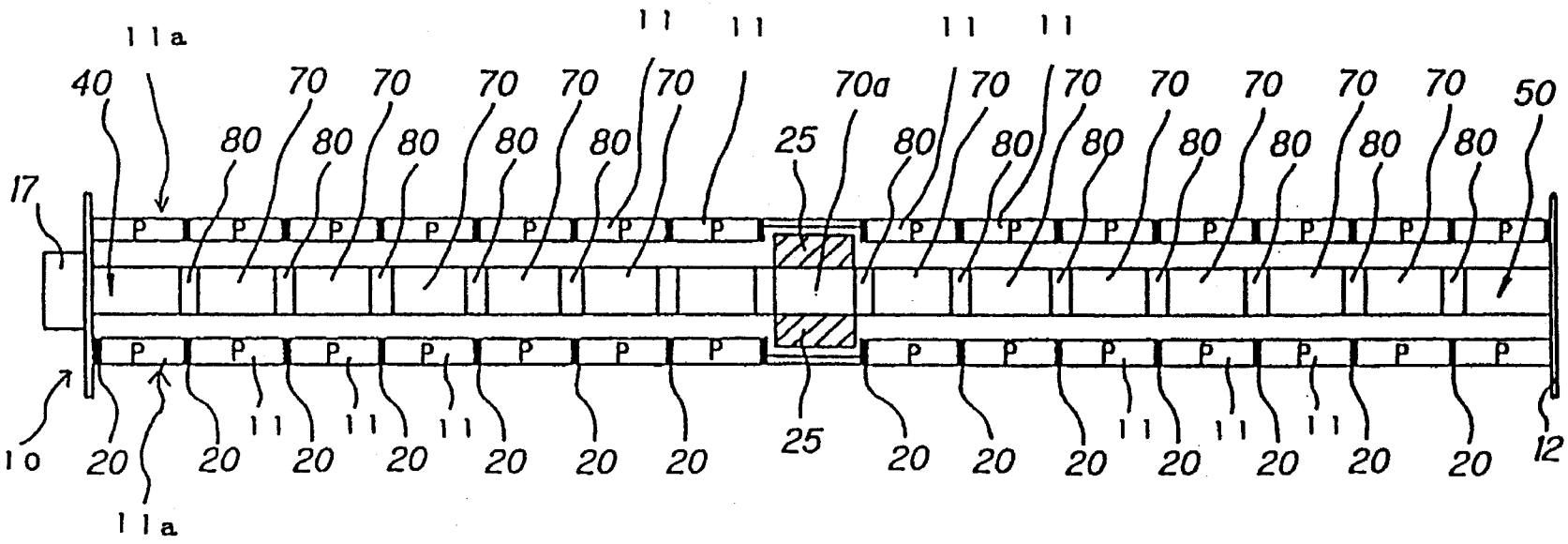
FIG. 1 is a conceptual plan view of a gaming machine island according to one embodiment of the invention.

As shown in FIG. 1, a gaming machine island 10 has two gaming machine rows 11*a* facing in opposite directions, each row consisting of gaming machines 11, 11 . . . . In the gaming machine row 11*a*, a pachinko ball lending machine 20 for dispensing pachinko balls used in the gaming machines 11 is placed between the adjacent gaming machines 11. Further, a pachinko ball lending machine 20 of the same model is installed at the end of the gaming machine row 11*a*. Polishers 25 for polishing pachinko balls are disposed at the center of the gaming machine island 10.

Figure 2:
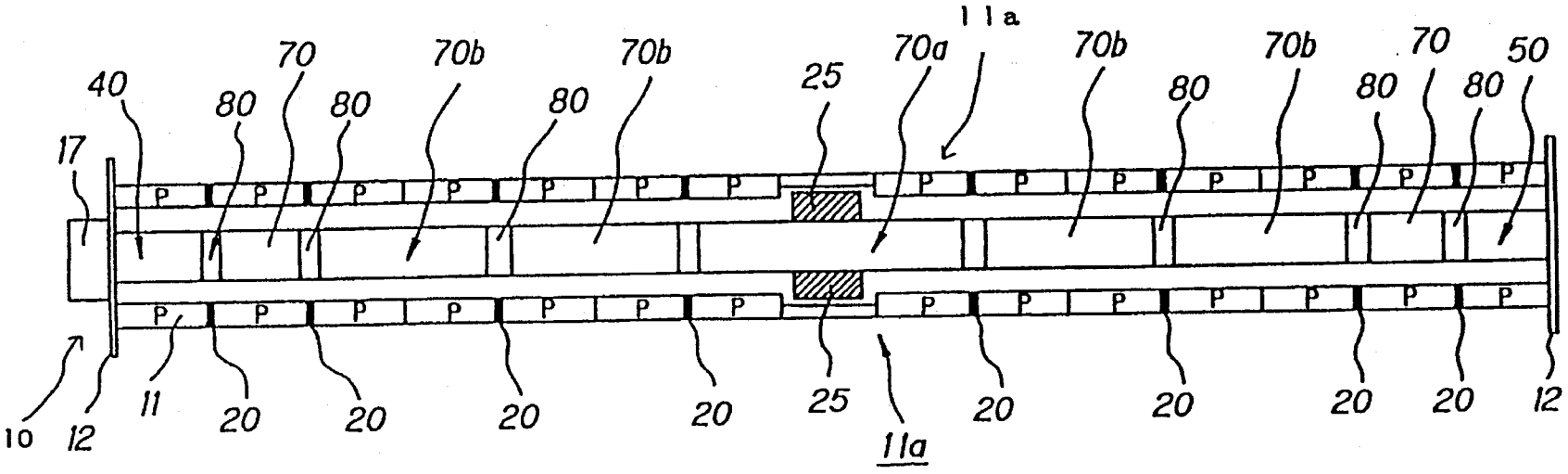
FIG. 2 is a conceptual plan view of another gaming machine island according to the embodiment of the invention.

Each gaming machine row 11*a* of a gaming machine island 10 as shown in FIG. 2 has pachinko ball lending machines 20, each placed for every two gaming machines 11.

Figure 3:
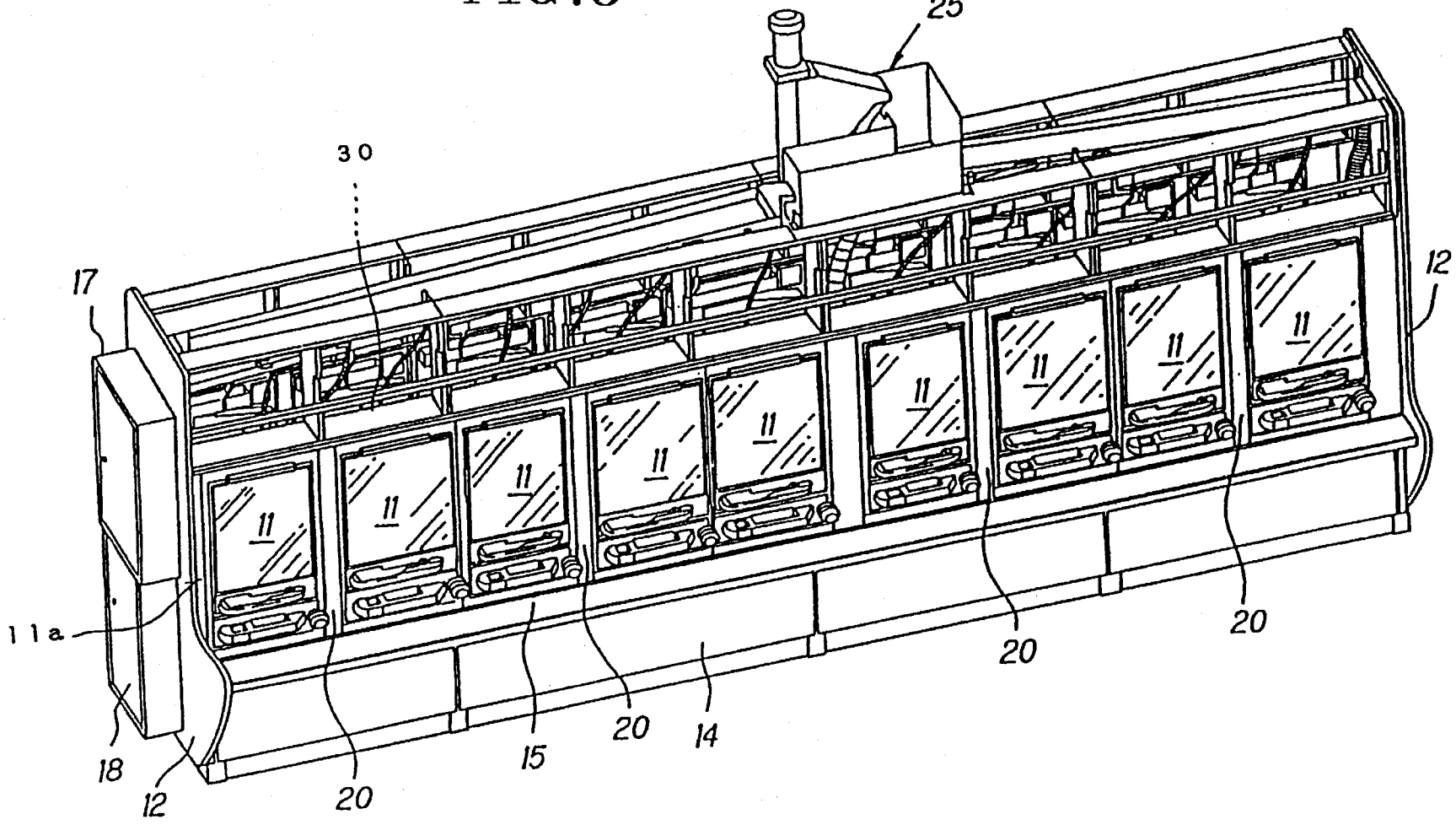
FIG. 3 is a perspective view of the gaming machine island according to the embodiment of the invention.
Figure 4:
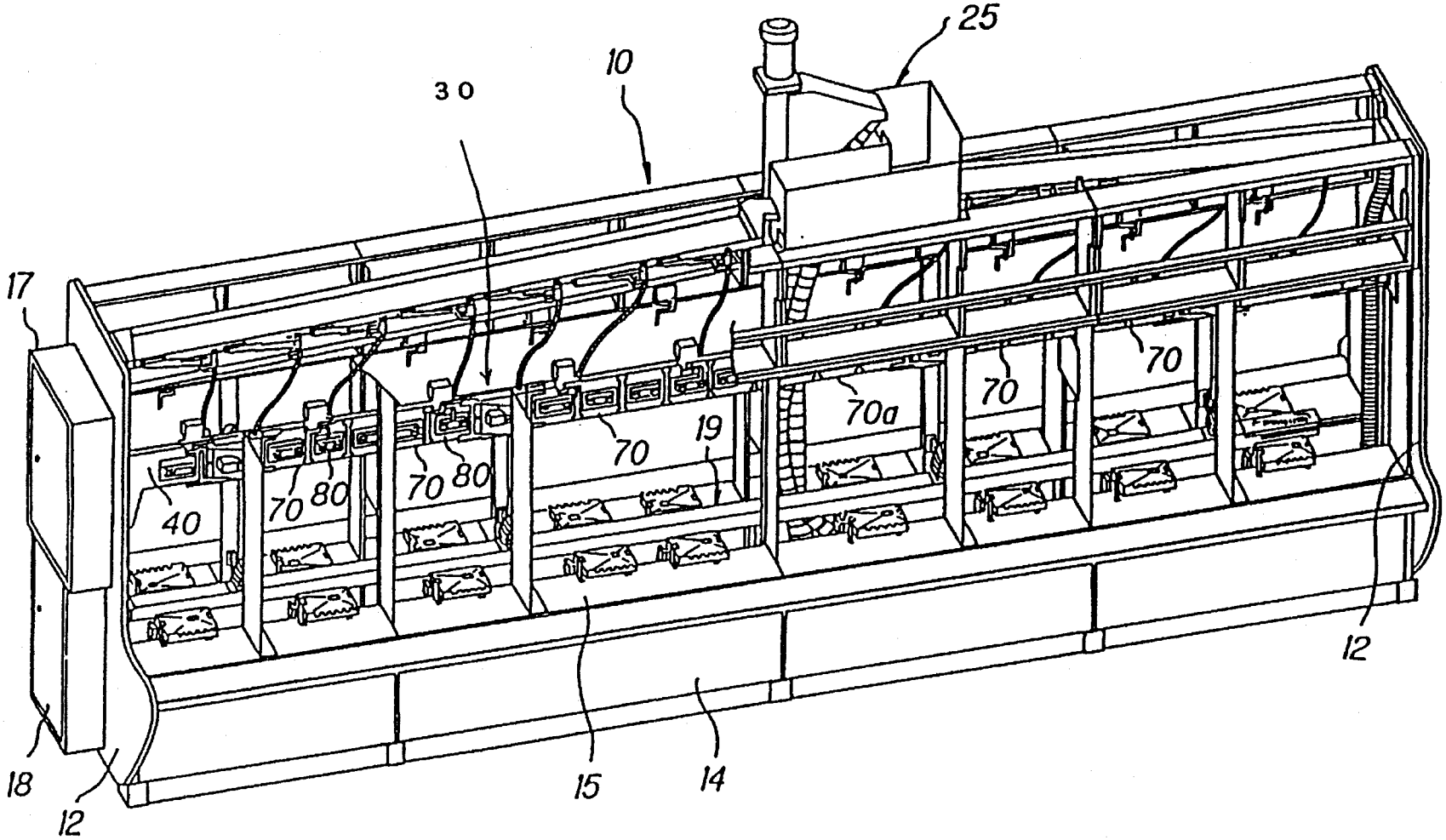
FIG. 4 is a perspective view of the gaming machine island according to the embodiment of the invention from which gaming machines are removed.
Figure 5:
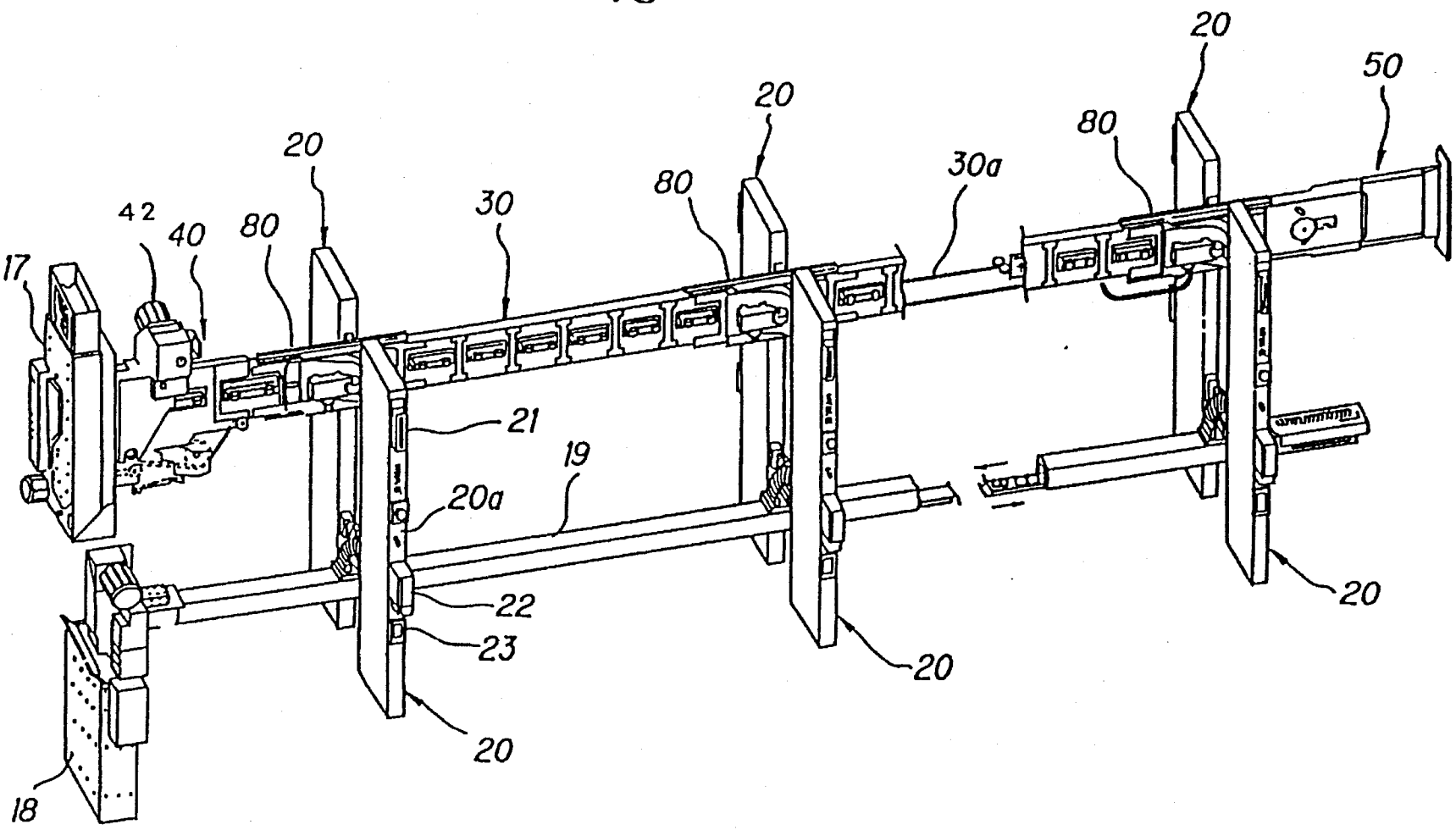
FIG. 5 is a perspective view of a transporter of the gaming machine island according to the embodiment of the invention.
Figure 6:
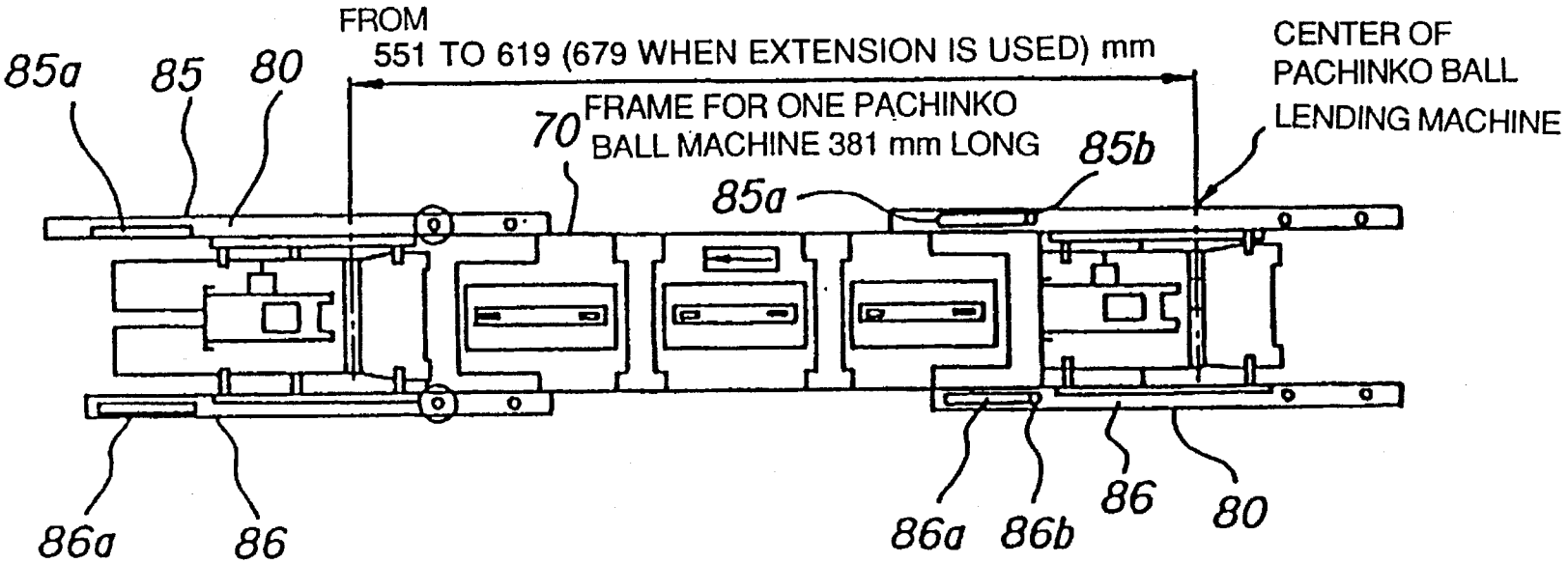
FIG. 6 is a front view showing a transport unit, etc., of the transporter of the gaming machine island according to the embodiment of the invention.

As shown in FIGS. 3 to 5, the gaming machines 11 and the pachinko ball lending machines 20 are placed on top of a top board 15 fixed to the upper ends of wainscot panels 14 making up the base of the entire island. The wainscot panels 14 and the top board 15 are located at the bottom between end plates 12 and 12, both ends of the island placed on the floor of the gaming house.

A bill transporter 30 is located on the top of the rear side of each gaming machine row 11*a*. The bill transporter 30 collects bills taken into the pachinko ball lending machines 20 and transports the bills along a bill collection line (transport passage) to a bill collector 17 fixed to the end plate 12 at one end of the island. The bill collection line includes a main bill transport line in parallel along the gaming machine rows 11*a* and introduction lines guiding bills from the pachinko ball lending machines 20 to the main bill transport line. A coin collector 18 is also fixed to the end plate 12 below the bill collector 17. A coin transport line 19 for feeding, into the coin collector 18, coins taken into the pachinko ball lending machines 20 is provided along the bottom of the rear side of each gaming machine row 11*a*.

As shown in FIG. 5, the pachinko ball lending machine 20 is formed like a narrow rectangular parallelopiped and has a bill and coin slot 21 in the upper part on a front 20*a* and a pachinko ball pot 22 and a coin return 23 in the lower part of the front 20*a*. A bill validator (not shown) comprising a bill determination section is provided in the bill and coin slot 21 and a bill discharge port (not shown) is opened backward from the rear of the bill validator.

As shown in FIG. 5, the bill transporter 30 has a driving pulley (not shown) disposed on one end of the gaming machine rows 11*a*, a driven pulley (not shown) disposed on the opposite end of the gaming machine rows 11*a*, and a round conveyer belt 30*a* placed on the driving and driven pulleys for turning. The pulled side of the round belt 30*a* extends along the main bill transport line. The pulled side of the round belt 30*a* refers to a portion of the round belt 30*a* pulled from the driven pulley to the driving pulley when the driving pulley rotates.

Figure 7:
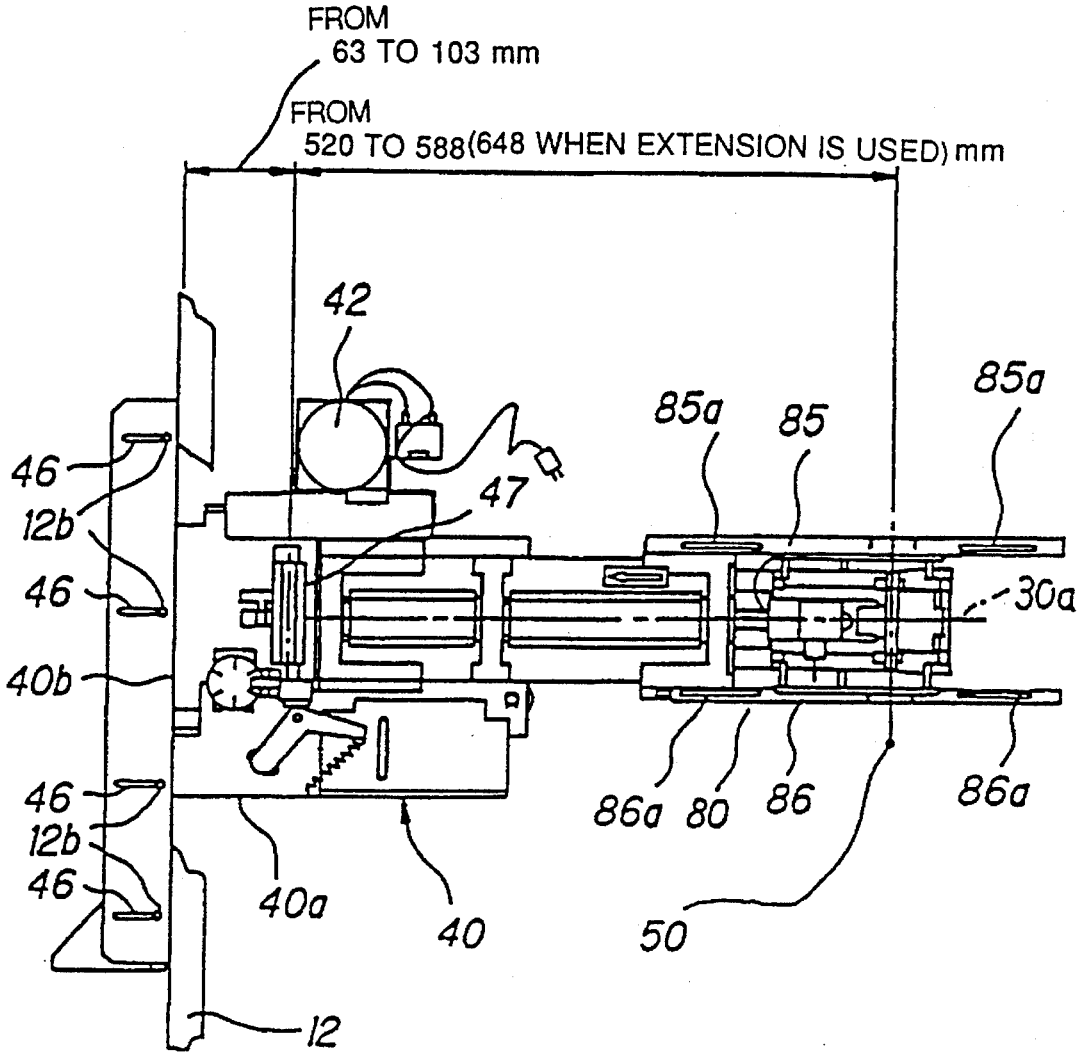
FIG. 7 is a front view showing a drive unit, etc., of the transporter of the gaming machine island according to the embodiment of the invention.

As shown FIGS. 5 and 7, a drive unit 40 having driving pulley for turning the round belt 30*a* is connected to one end of the main bill transport line. The drive unit 40 comprises a drive frame 40*a* fixed to the end plate 12 forming one end of the main bill transport line, an electric motor 42 disposed above the drive frame 40*a*, and the driving pulley turned via a transmission mechanism by the electric motor 42.

The drive unit 40 is formed as shown in FIGS. 4, 5, and 7. The drive frame 40*a* has a side wall 40*b* for attaching the frame 40*a* to the end plate 12. The side wall 40*b* of the drive frame 40*a* is formed with holes 46, 46 . . . elongated in a direction parallel with the main bill transport line, as shown in FIG. 7. Connecting screws 12*b*, 12*b* . . . are inserted into the elongated holes 46, 46 . . . and are screwed in the end plate 12, thereby fixing the drive frame 40*a* to the end plate 12.

An introduction passage member 47 communicated with the bill discharge port of the pachinko ball lending machine 20 placed at the left end of the gaming machine row 11*a* for guiding bills discharged therefrom directly to the round belt 30*a* is integral with the side wall 40*b* of the drive frame 40*a*.

Figure 9:
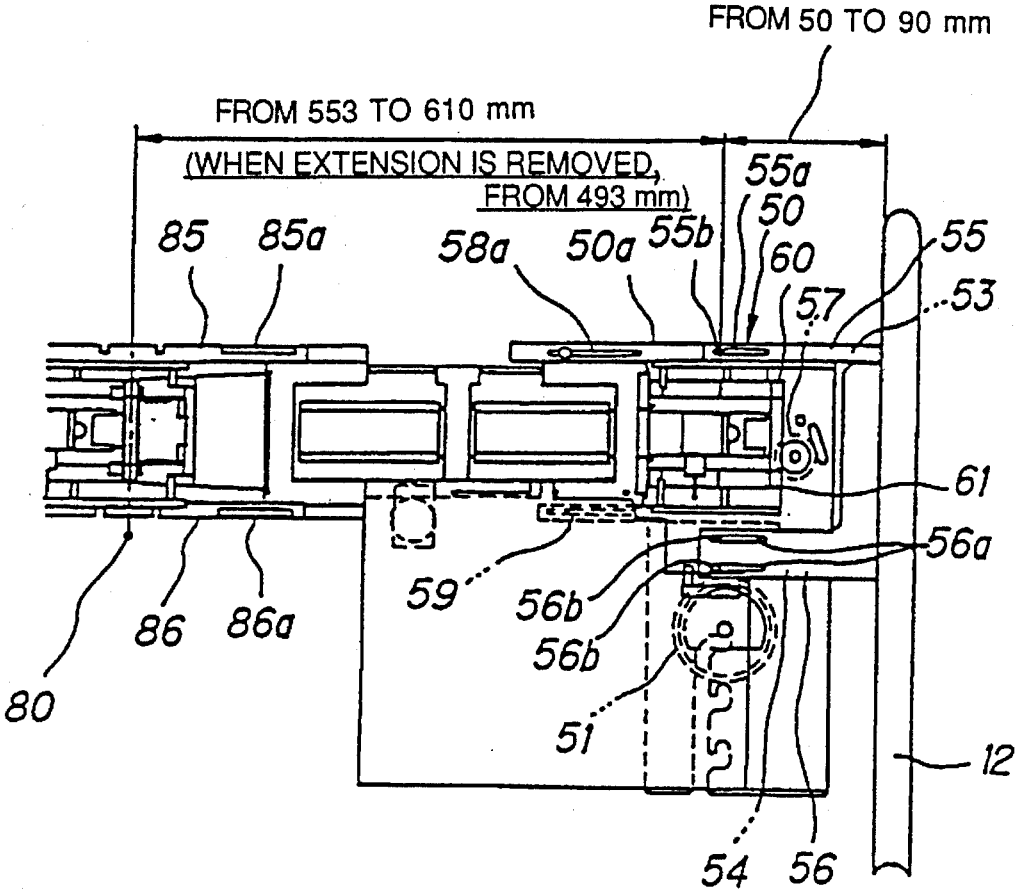
FIG. 9 is a front view showing a driven unit, etc., of the transporter of the gaming machine island according to the embodiment of the invention.

As shown in FIG. 9, a driven unit 50 having driven pulley 51 on which the round belt 30*a* is placed is connected to the other end of the main bill transport line. The driven unit 50 comprises a combination of a driven frame 50*a* fixed movably to the end plate 12 via a lower guide bracket 56 forming the other end of the main bill transport line and an introduction passage support 60 capable of adjusting an installation position overlapping the driven frame 50*a*.

Both an upper guide bracket 55 and the lower guide bracket 56 are fixed to the end plate 12. The upper guide bracket 55 is formed with an adjustment hole 55*a* elongated in the transport direction and the lower guide bracket 56 is formed with two adjustment holes 56*a* and 56*a* parallel with each other and elongated in the transport direction.

The driven frame 50*a* has an upper rail part 53 and a lower rail part 54 fitted slidably into the upper guide bracket 55 and the lower guide bracket 56 respectively. Connecting screws 55*b* and 56*b* are screwed into the upper rail part 53 and the lower rail part 54. The connecting screws 55*b* and 56*b* are inserted into the elongated holes 55*a* and 56*a* of the guide brackets 55 and 56 so that they can move relatively in the transport direction. That is, the driven frame 50*a* is supported by the end plate 12 so that the position of the driven frame 50*a* in the transport direction with respect to the end plate 12 can be adjusted by the connecting screws 55*b* and 56*b*.

The introduction passage support 60 forming a part of the driven unit 50 has an introduction passage member 61, which is communicated with the bill discharge port of the pachinko ball lending machine 20 placed at the right end of the gaming machine row 11*a* for guiding bills discharged therefrom to the round belt 30*a*.

Figure 10:
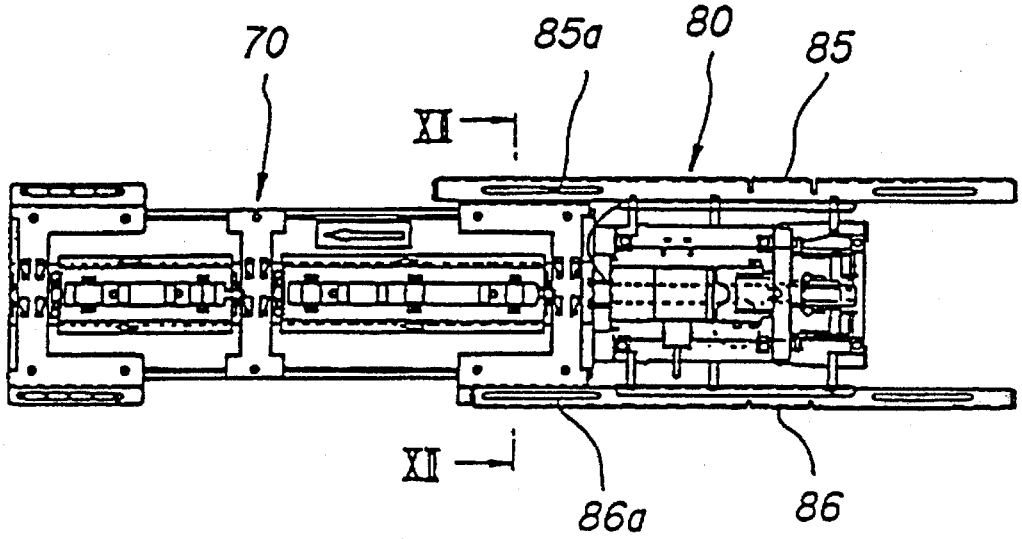
FIG. 10 is a front view showing an introduction unit, etc., of the transporter of the gaming machine island according to the embodiment of the invention.
Figure 11:
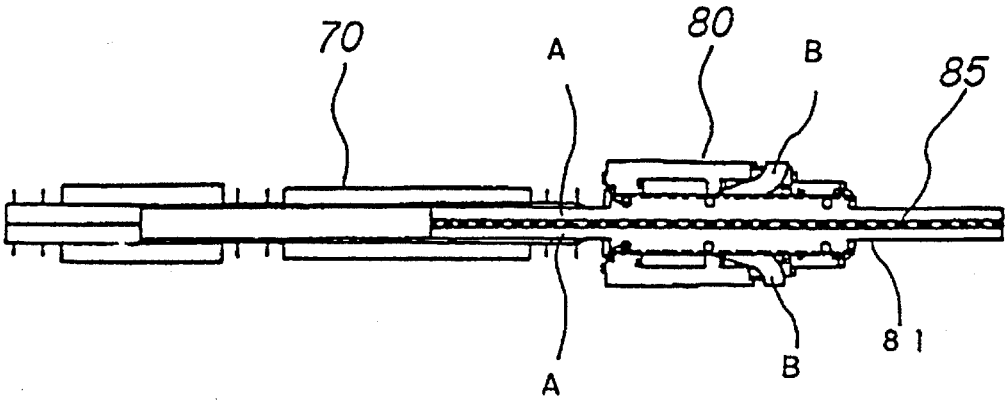
FIG. 11 is a plan view showing the introduction unit, etc., of the transporter of the gaming machine island according to the embodiment of the invention.
Figure 12:
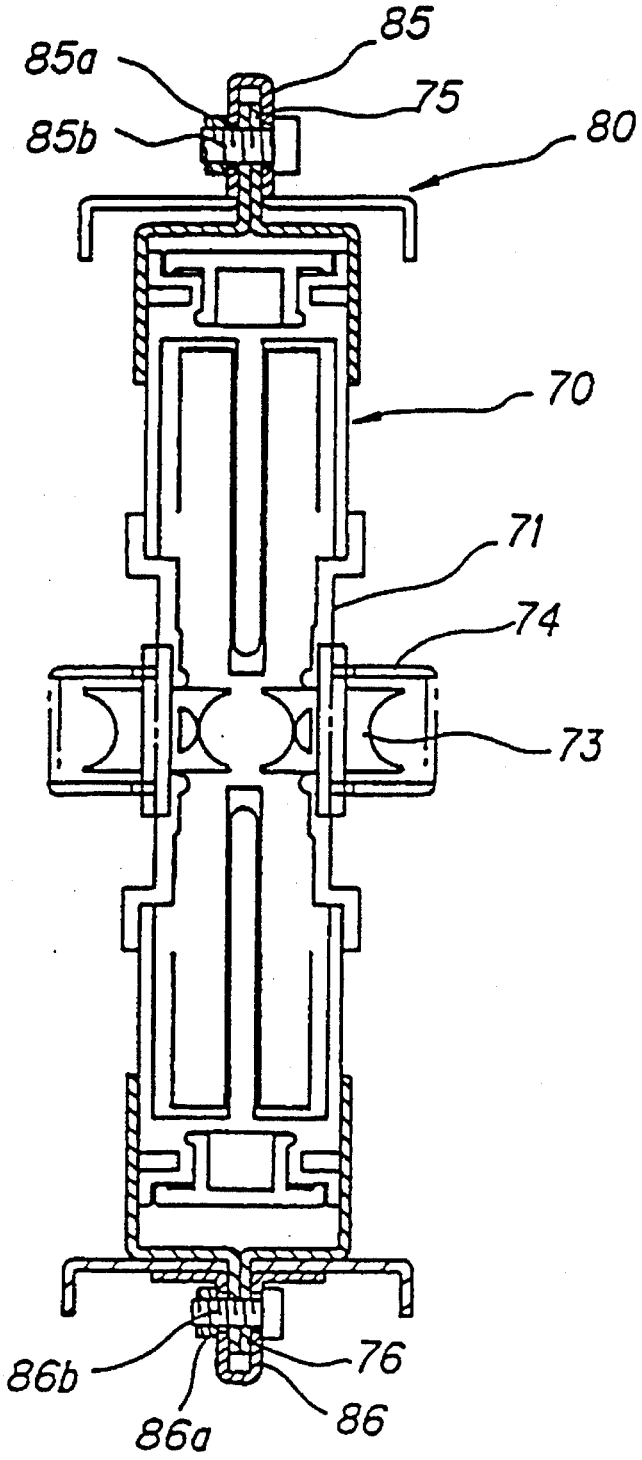
FIG. 12 is a sectional view taken on line XII—XII of FIG. 10.

As shown in FIGS. 10 to 12, the bill collection line comprises introduction units 80 communicated with the bill discharge ports of the pachinko ball lending machines 20 each placed between the gaming machines 11 and connected to transport units 70 and the transport units 70 for transporting bills to the bill collector 17. Adjustment holes 85*a* and 86*a* elongated in the transport direction are formed in an upper mounting bracket 85 and a lower mounting bracket 86 of the introduction unit 80 having an introduction passage B for guiding bills from the pachinko ball lending machine 20 to main transport passage A and a frame 81 forming the main transport passage leading to the introduction passage, as shown in FIG. 11. Each of the upper and lower mounting brackets 85 and 86 is formed as a groove-like section. An upper flange 75 and a lower flange 76 of the transport unit 70 are fitted into grooves of the upper and lower mounting brackets 85 and 86 so as to be movable in the transport direction: Connecting screws 85*b* and 86*b* screwed into the upper and lower flanges 75 and 76 are inserted into the elongated holes 85*a* and 86*a* of the brackets 85 and 86 for connecting the transport unit 70 and the introduction unit 80 after the mutual positional relationship between both units is adjusted. That is, when the connecting screws 85*b* and 86*b* are loose, the mutual positional relationship between both the transport unit 70 and the introduction unit 80 can be changed within the range of the length of the elongated holes 85*a*, 86*a*.

FIG. 7 shows connection of the drive unit 40 and the introduction unit 80. Like the relationship between the transport unit 70 and the introduction unit 80, the mutual positional relationship between both the drive unit 40 and the introduction unit 80 can be changed within the range of the length of the elongated holes 85*a*, 86*a* of the introduction unit 80.

The upper and lower flanges of the drive unit 40 are fitted into the grooves of the upper and lower mounting brackets 85 and 86 of the introduction unit so as to be 80 movable in the transport direction. In the figure, the upper and lower flanges of the drive unit 40 are not shown because they are fitted into the upper and lower mounting brackets 85 and 86 of the introduction unit 80 and are concealed therein. To connect the drive unit 40 and the introduction unit 80, the upper and lower flanges of the drive unit 40 are fitted into the grooves of the upper and lower mounting brackets 85 and 86 of the introduction unit 80 and the mutual positional relationship between both the units is adjusted. The connecting screws are then inserted through the elongated holes 85*a* and 86*a* of the upper and lower mounting brackets 85 and 86 of the introduction unit 80 and screwed in the upper and lower flanges of the drive unit.

Likewise, FIG. 9 shows connection of the driven unit 50 and the introduction unit 80. Like the relationship between the transport unit 70 and the introduction unit 80, the mutual positional relationship between both the driven unit 50 and the introduction unit 80 can be changed within the range of the length of the elongated holes 85*a*, 86*a* of the introduction unit 80. The upper and lower flanges of the driven unit 50 are fitted into the grooves of the upper and lower mounting brackets 85 and 86 of the introduction unit 80 so as to be movable in the transport direction.

As shown in FIG. 12, the transport unit 70 has a pair of transport rollers 73 disposed at a key part. One side of one transport roller 73 in the pair disposed in the transport unit 70 is attached to a roller fitting plate 74 secured on the side wall of a transport passage member 71.

Figure 13:
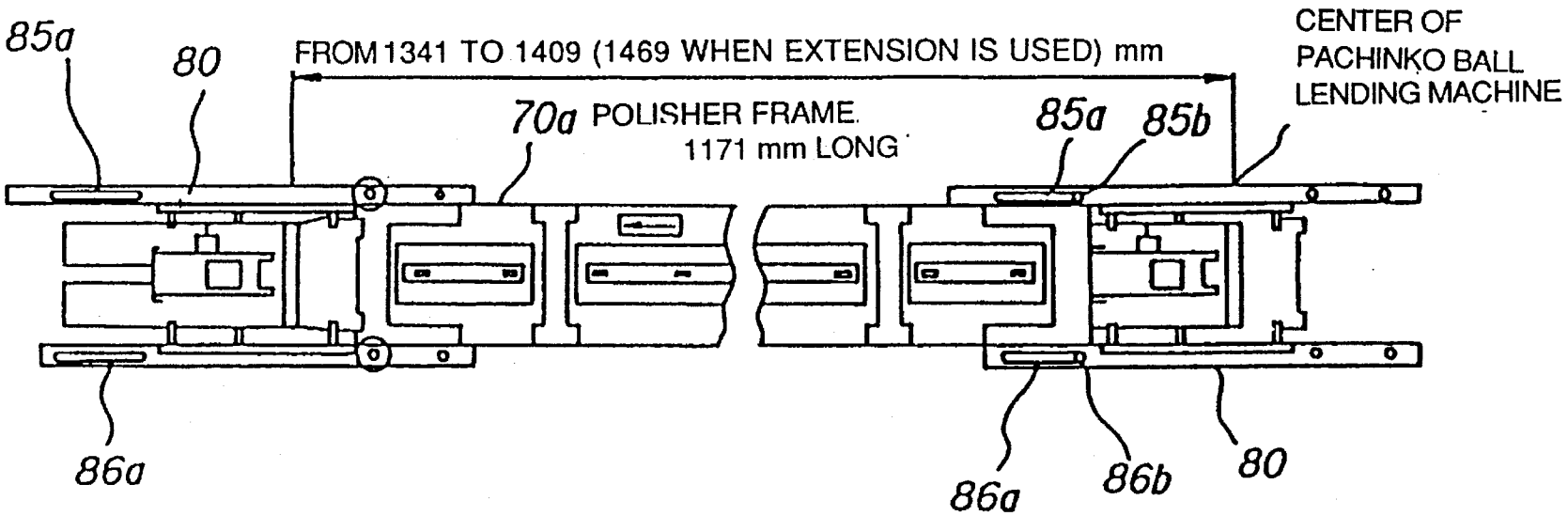
FIG. 13 is a front view showing a transport unit, etc., of the transporter of the gaming machine island according to the embodiment of the invention.
Figure 14:
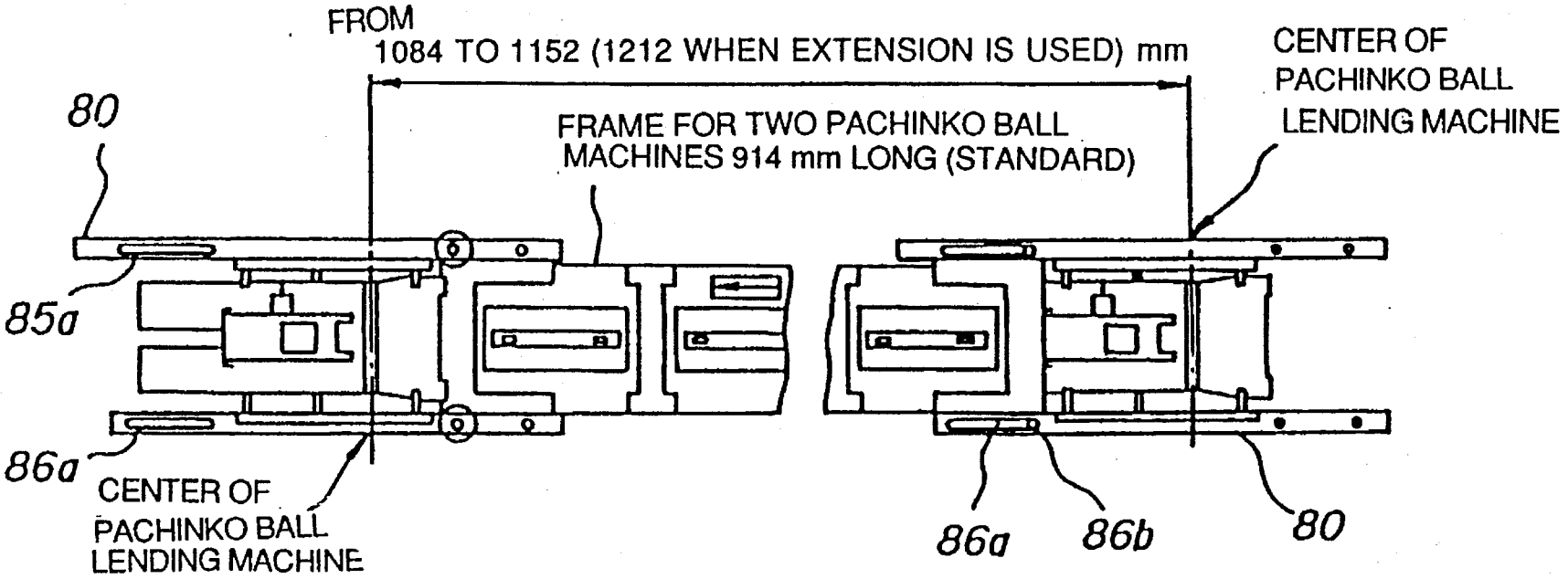
FIG. 14 is a front view showing the transport unit, etc., of the transporter of the gaming machine island according to the embodiment of the invention.
Figure 15:
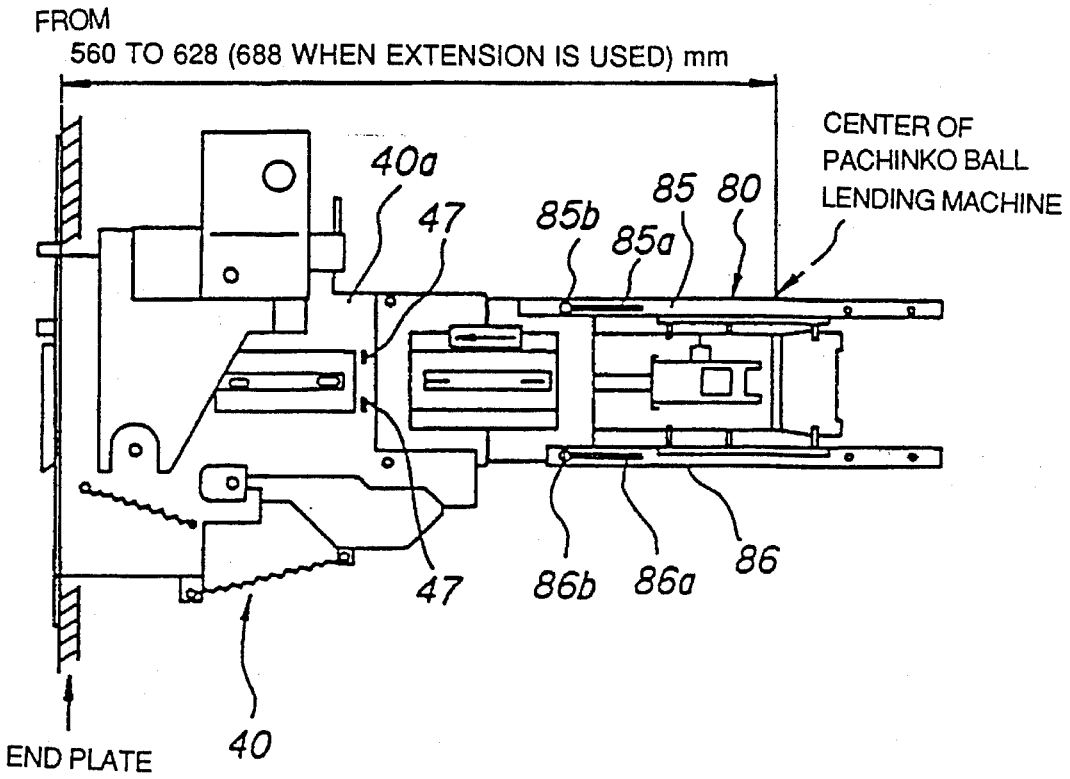
FIG. 15 is a front view showing the drive unit, etc., of the paper slip transporter of the gaming machine island according to the embodiment of the invention.

As shown in FIG. 13, in the gaming machine island 10, a polisher frame 70*a* comprising a sequence of transport units 70 is located on the transport passage positioned on the rears of the polishers 25. As shown in FIG. 14, in the gaming machine island 10 comprising pachinko ball lending machines 20 each placed for every two gaming machines 11, likewise a frame 70*b* for two gaming machines 11 comprising a sequence of transport units 70 is located on the transport passage positioned on the rears of the two gaming machines 11.

Figure 16:
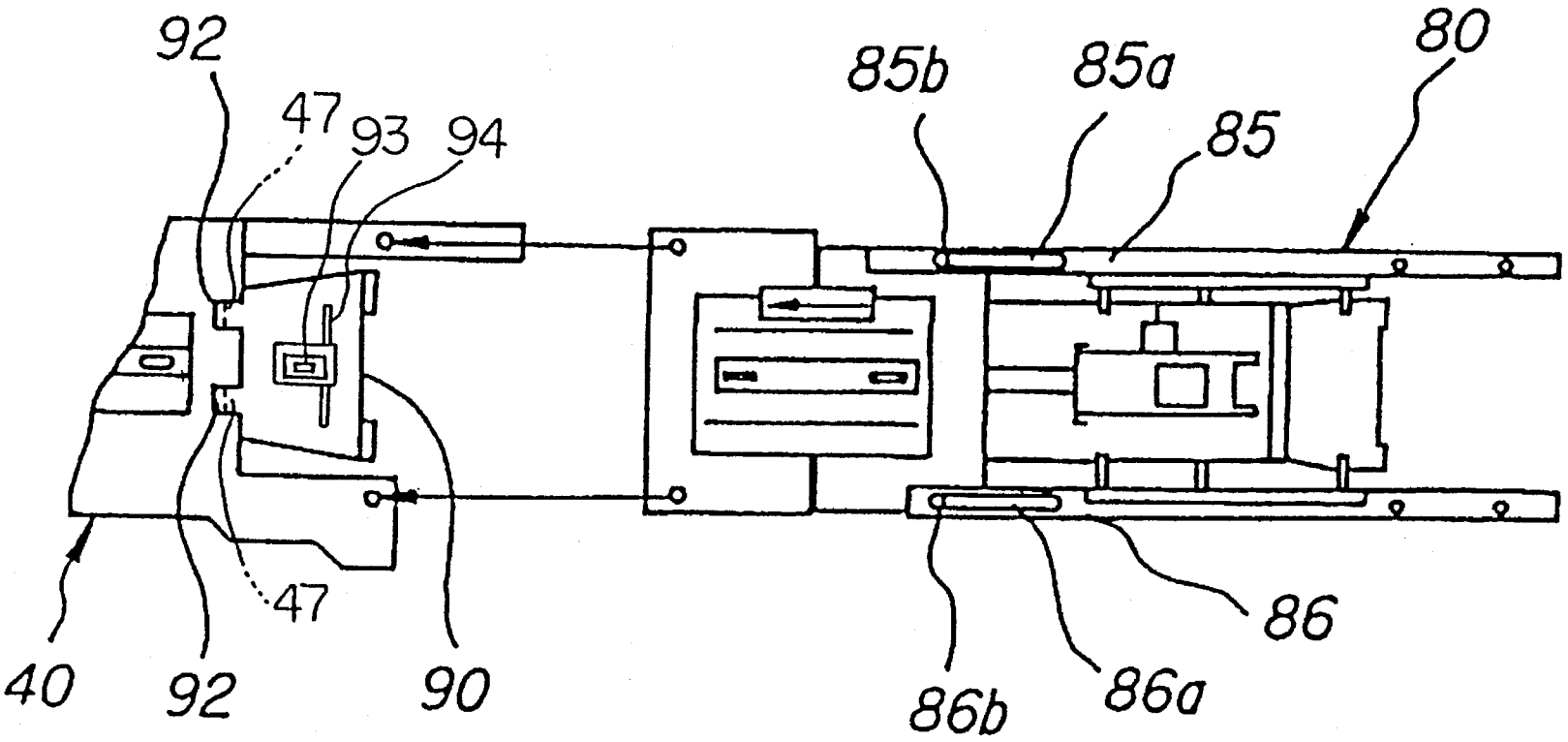
FIG. 16 is a front view showing the drive unit, etc., of the paper slip transporter of the gaming machine island according to the embodiment of the invention.
Figure 17:
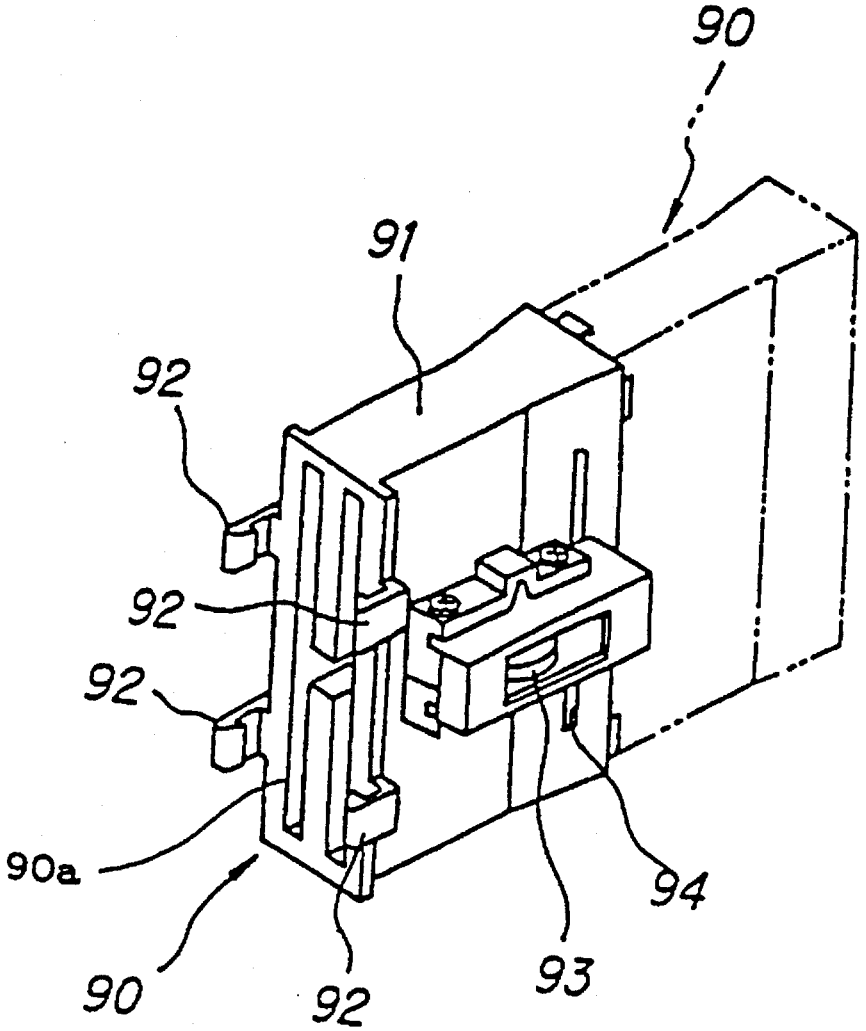
FIG. 17 is a perspective view of a frame extension of the gaming machine island according to the embodiment of the invention.
Figure 18:
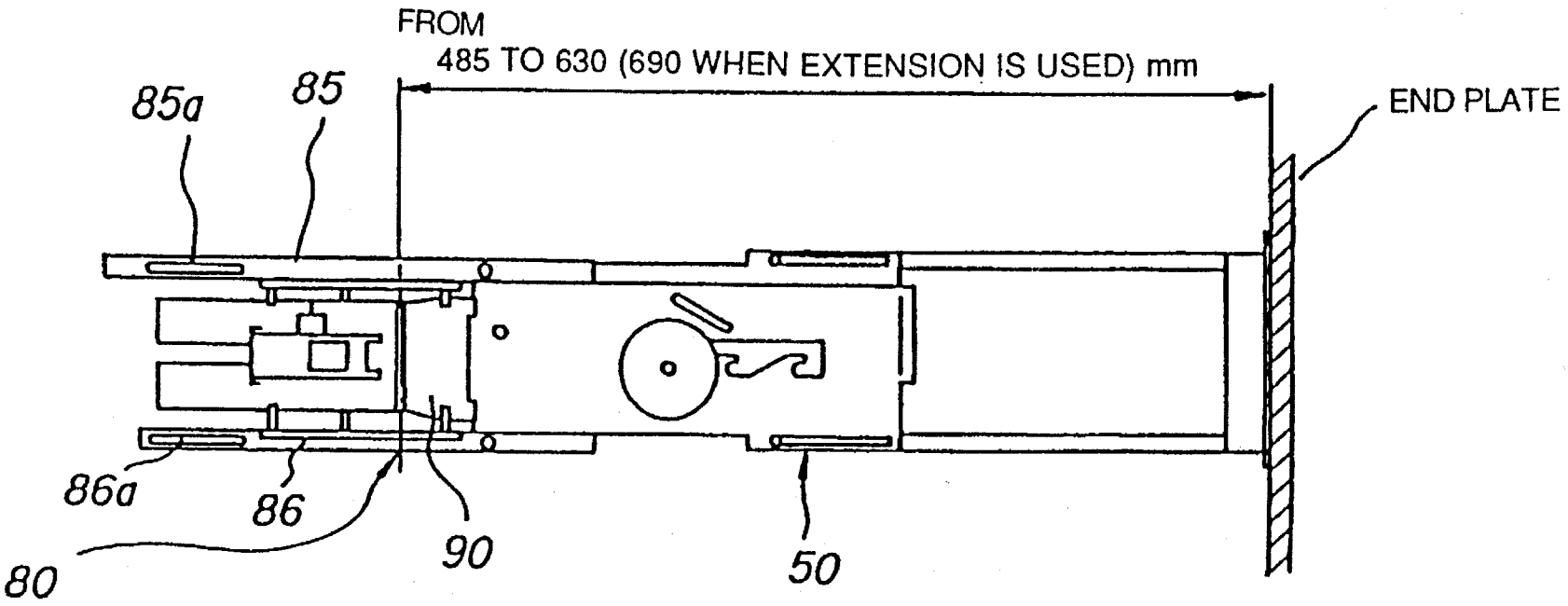
FIG. 18 is a front view showing the driven unit, etc., of the paper slip transporter of the gaming machine island according to the embodiment of the invention.
Figure 19:
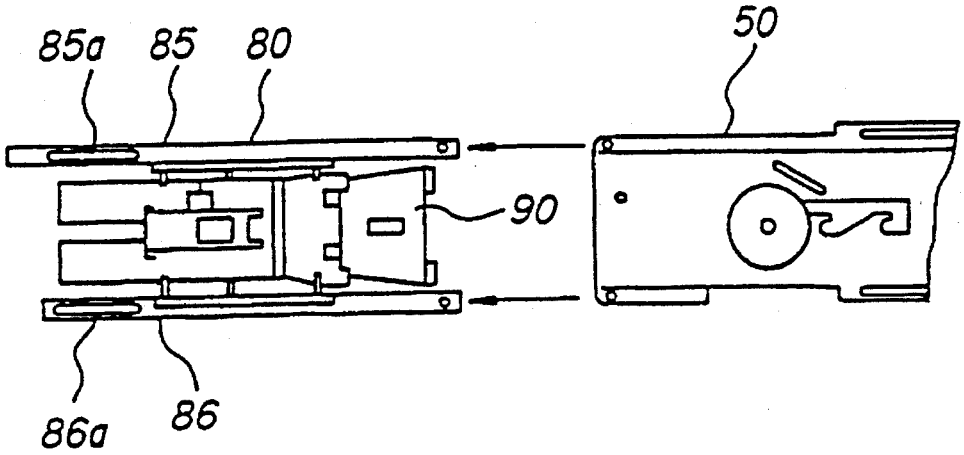
FIG. 19 is an exploded front view showing the frame extension, etc., of the gaming machine island according to the embodiment of the invention.
Figure 20:
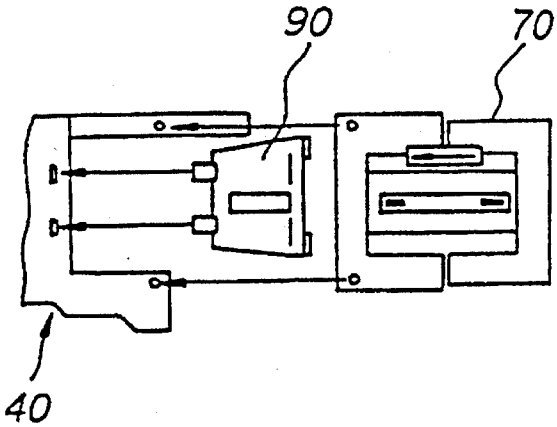
FIG. 20 is an exploded front view showing the frame extension, etc., of the gaming machine island according to the embodiment of the invention.
Figure 21:
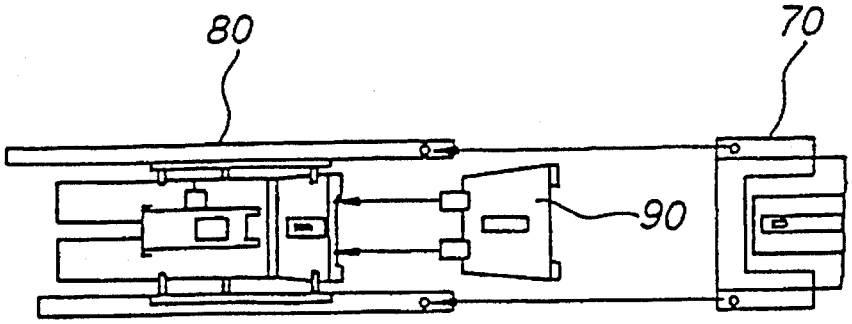
FIG. 21 is an exploded front view showing the frame extension, etc., of the gaming machine island according to the embodiment of the invention.

As shown in FIGS. 16 and 17, a main body 91 of a frame extension 90 is formed with a groove 90*a* having a substantially H-shaped section forming the transport passage extending in the transport direction. Hooks 92, 92 . . . engaging connection holes 47 (shown in FIG. 15) made in the end of the drive frame 40*a* of the drive unit 40 are formed on one end of the frame extension 90. A vertically elongated connection hole 94 is made in the opposite end of the frame extension 90. A hook 92 of another frame extension 90 can be engaged into the elongated connection hole 94 for connecting the frame extensions 90 to each other. A pair of transport rollers 93 is disposed at the vertical center of the frame extension 90.

Figure 8:
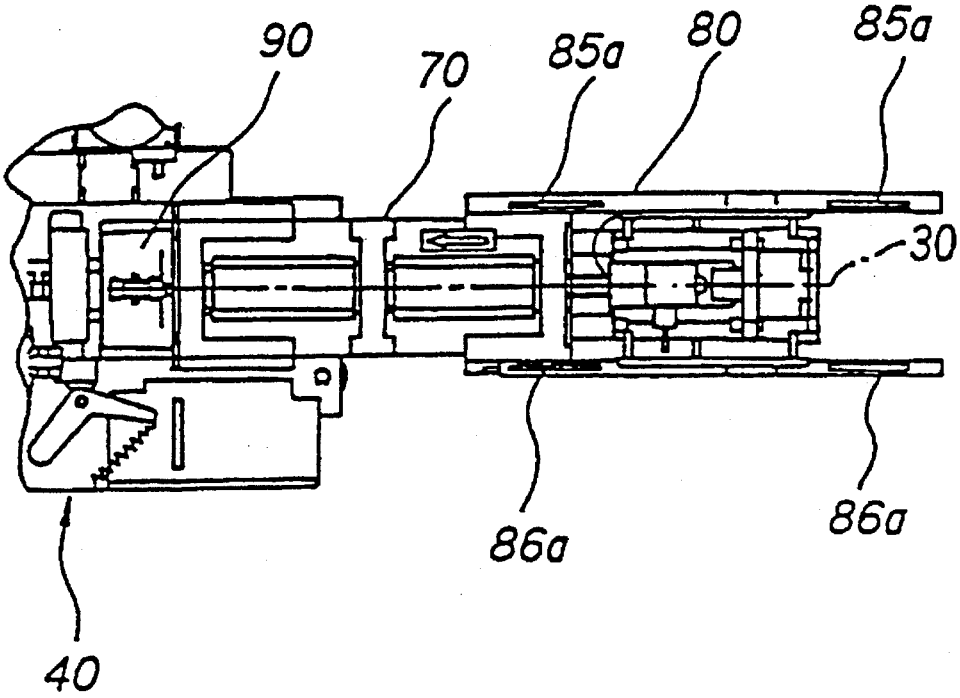
FIG. 8 is a front view showing a drive unit, etc., of the transporter of the gaming machine island according to the embodiment of the invention.

As shown in FIG. 8, the introduction unit 80 and the drive unit 40 may be connected by the frame extension 90. Likewise, as shown in FIGS. 18 to 21, the introduction unit 80 and the driven unit 50 may be connected by the frame extension 90, or the transport unit 70 and the introduction unit 80 may be connected by the frame extension 90.

The pulled side of the round belt 30*a* (FIG. 5) is placed so as to pass through the introduction units 80 and the transport units 70 forming the bill collection line, or the pairs of transport rollers 73 (FIG. 12) of the 13 frame extensions 90.

Next, the function will be discussed.

When the transport unit 70 and the introduction unit 80 are connected, if problems occur because of the outer frame dimension difference between the gaming machines 11 or a combination of the gaming machine 11 and pachinko ball lending machine 20, the transport unit 70 and the introduction unit 80 are expanded or contracted in the transport direction. At that time, the upper and lower flanges 75 and 76 of the transport unit 70 are guided and slid to the grooves of the upper and lower mounting brackets 85 and 86 of the introduction unit 80, and the fastening screws 85*b* and 86*b* screwed in the upper and lower flanges 75 and 76 relatively move in the elongated holes 85*a* and 86*a* of the upper and lower mounting brackets 85 and 86.

If the transport unit 70 and the introduction unit 80 are in alignment with the positions of the gaming machine 11 and the pachinko ball lending machine 20, they are fixed unmovably by the adjustment screws 85*b* and 86*b*.

Likewise, if problems occur when the drive unit 40 and the introduction unit 80 are connected, the drive unit 40 and the introduction unit 80 are expanded or contracted in the transport direction. If the drive unit 40 and the introduction unit 80 are in alignment with the positions of the gaming machine 11 and the pachinko ball lending machine, 20 they are fixed by the connecting screws.

Likewise, if problems occur when the driven unit 50 and the transport unit 70 are connected, the driven unit 50 and the transport unit 70 are expanded or contracted in the transport direction. If the driven unit 50 and the transport unit 70 are in alignment with the positions of the gaming machine 11 and the pachinko ball lending machine 20, they are fixed by the connecting screws.

Likewise, if problems occur when the drive unit 40 is connected to the end plate 12, the drive unit 40 is moved to the end plate 12 in the transport direction. At that time, the connection screws 12*b* relatively move in the elongated adjustment holes 46.

If the drive unit 40 is placed in a predetermined position with respect to the end plate 12 and is fixed by the connecting screws 12*b*, the drive unit 40 can be easily attached to the end plate 12.

In the embodiment, the invention is applied to pachinko ball machine islands, but not limited to them. The invention may be applied to slot machine islands. In this case, of course, the gaming machines are slot machines and game play media lending machines are game coin dispensers.

We claim:

1. A gaming machine island comprising a gaming machine row consisting of a plurality of gaming machines, for players to play games with game play media, arranged in a row, game play media lending machines, each placed between the gaming machines for dispensing the game play media when a bill is inserted, and a bill transporter for transporting bills in a main bill transport passage formed along the gaming machine row, wherein the game play media lending machines and introduction passages are formed for guiding bills from the game play media lending machines to the main bill transport passage, characterized in that:

said bill transporter comprises introduction units, each having an introduction frame formed with at least said introduction passage, and transport units, each having a transport frame formed with at least a part of said main bill transport passage, said transport units being connected to said introduction units so as to enable the main bill transport passage of the transport frames to receive bills passed through the introduction passages of said introduction units; in that each of said introduction frames has a guide member extending in a direction parallel with the main bill transport passage; in that each of said transport frames has a guided member extending in a direction parallel with the main bill transport passage and fitted into said guide member of said introduction frame; in that either of said guide and guided members is formed with a hole elongated in .a direction parallel with the main bill transport passage; and in that said guided member of said transport unit is fitted into said guide member of said introduction unit and a screw is inserted into the elongated hole made in one member of said guide and guided members and is screwed in the other member for connecting both the introduction and transport units in order for the position of the transport unit and introduction unit to be expanded or contracted for adjustment in a transport direction in order to match the outer frame dimensions of a respective gaming machine and game play media lending machine for proper bill transportation from the bill slot to the bill transporter.

2. The gaming machine island as claimed in claim 1 wherein said bill transporter further includes a drive unit, having a driving pulley and a drive frame forming one end of the main bill transport passage, and being connected to said introduction unit so as to enable the main bill transport passage of the drive frame to receive the bills passed through the introduction passages of said introduction units, a driven unit, having a driven pulley and a driven frame forming the opposite end of the main bill transport passage and connected to said introduction unit, and a bill conveyor belt disposed in the main bill transport passage and placed on said driving and driven pulleys, wherein;

said drive frame has a guided member extending in a direction parallel with the main bill transport passage and fitted into said guide member of said introduction frame;

either of said guide member of said introduction frame and said guided member of said drive frame is formed with a hole elongated in a direction parallel with the main bill transport passage; and said guided member of said drive unit is fitted into said guide member of said introduction unit and a screw is inserted into the elongated hole made in one member of said guide and guided members and is screwed in the other member for connecting both the introduction and drive units in order for the position of the drive unit and introduction unit to be expanded or contracted for adjustment in a transport direction if the position of the drive unit changes.

3. The gaming machine island as claimed in claim 2 wherein said driven frame has a guided member extending in a direction parallel with the main bill transport passage and fitted into said guide member of said introduction frame, wherein:

either of said guide member of said introduction frame and said guided member of said driven frame is formed with a hole elongated in the direction parallel with the main bill transport passage; and said guided member of said driven unit is fitted into said guide member of said introduction unit and a screw is inserted into the elongated hole made in one member of said guide and guided members and is screwed in the other member for connecting both the introduction and driven units in order for the position of the driven unit and introduction unit to be expanded or contracted for adjustment in a transport direction if the position of the driven unit changes.

4. The gaming machine island as claimed in claim 3 wherein said bill transporter further includes a drive unit support member being fixed to an installation face of said gaming machine island for supporting said drive unit and a driven unit support member being fixed to the installation face of said gaming machine island for supporting said driven unit, wherein:

either of said drive frame and said drive unit support member is formed with a hole elongated in a direction parallel with the main bill transport passage;

a screw is inserted into the elongated hole formed in one of said drive frame and said drive unit support member and is screwed into the other for connecting both said drive unit and said drive unit support member in order for the position of the drive frame and drive unit support member to be expanded or contracted for adjustment in a transport direction if the position of the drive unit support member changes;

either of said driven frame and said driven unit support member is formed with a hole elongated in the direction parallel with the main bill transport passage; and a screw is inserted into the elongated hole formed in one of said driven frame and said driven unit support member and is screwed into the other for connecting both said driven unit and said driven unit support member in order for the position of the driven frame and driven unit support member to be expanded or contracted for adjustment in a transport direction if the position of the driven unit support member changes.

5. The gaming machine island as claimed in claim 1 wherein said bill transporter further includes a drive unit having a driving pulley and a drive frame forming one end of the main bill transport passage and connected to said introduction unit so as to enable the main bill transport passage of the drive frame to receive the bills passed through the introduction passages of said introduction units, a driven unit having a driven pulley and a driven frame forming the opposite end of the main bill transport passage and connected to said introduction unit, and a bill conveyor belt disposed in the main bill transport passage and placed on said driving and driven pulleys, wherein:

said driven frame has a guided member extending in a direction parallel with the main bill transport passage and fitted into said guide member of said introduction frame;

either of said guide member of said introduction frame and said guided member of said driven frame is formed with a hole elongated in the direction parallel with the main bill transport passage; and said guided member of said driven unit is fitted into said guide member of said introduction unit and a screw is inserted into the elongated hole made in one member of said guide and guided members and is screwed in the other member for connecting both the introduction and driven unit in order for the position of the drive frame and drive unit support member to be expanded or contracted for adjustment in a transport direction if the position of the drive unit support member changes.

6. The gaming machine island as claimed in claim 1 wherein said bill transporter further includes a drive unit having a driving pulley and a drive frame forming one end of the main bill transport passage and connected to said introduction unit so as to enable the main bill transport passage of the drive frame to receive the bills passed through the introduction passages of said introduction units, a driven unit having a driven pulley and a driven frame forming the opposite end of the main bill transport passage and connected to said introduction unit, a bill conveyor belt disposed in the main bill transport passage and placed on said driving and driven pulleys, a drive unit support member being fixed to an installation face of said gaming machine island for supporting said drive unit, and a driven unit support member being fixed to the installation face of said gaming machine island for supporting said driven unit, wherein:

either of said drive frame and said drive unit support member is formed with a hole elongated in a direction parallel with the main bill transport passage;

a screw is inserted into the elongated hole formed in one of said drive frame and said drive unit support member and is screwed in the other for connecting both said drive unit and said drive unit support member in order for the position of the drive frame and drive unit support member to be expanded or contracted for adjustment in a transport direction if the position of the drive unit support member changes;

either of said driven frame and said driven unit support member is formed with a hole elongated in the direction parallel with the main bill transport passage; and a screw is inserted into the elongated hole formed in one of said driven frame and said driven unit support member and is screwed in the other for connecting both said driven unit and said driven unit support member in order for the position of the driven frame and driven unit support member to be expanded or contracted for adjustment in a transport direction if the position of the driven unit support member changes.

* * * * *